US008794014B2

(12) United States Patent
Kulkarni et al.

(10) Patent No.: US 8,794,014 B2
(45) Date of Patent: Aug. 5, 2014

(54) ICE MAKING IN THE REFRIGERATION COMPARTMENT USING A COLD PLATE

(75) Inventors: Tushar Kulkarni, Saint Joseph, MI (US); Claiton Emilio Do Amaral, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 594 days.

(21) Appl. No.: 12/129,713

(22) Filed: May 30, 2008

(65) Prior Publication Data

US 2009/0293501 A1 Dec. 3, 2009

(51) Int. Cl.
*F25C 1/00* (2006.01)

(52) U.S. Cl.
USPC ..... 62/66; 62/356

(58) Field of Classification Search
CPC ..... F25C 5/005; F25C 2400/10; F25D 19/006
USPC ..... 62/66, 389, 441, 3.63, 353, 344
See application file for complete search history.

(56) References Cited

U.S. PATENT DOCUMENTS 413,136 A 10/1889 Dewey
2,435,102 A 1/1948 Rundell
2,436,389 A 2/1948 Kleist
2,677,242 A 5/1954 Grimshaw
3,075,360 A 1/1963 Elfving et al.
3,075,366 A 1/1963 Jung
3,100,970 A 8/1963 Elfving
3,144,078 A * 8/1964 Morton et al. ..... 165/263
3,146,601 A 9/1964 Gould
3,167,925 A 2/1965 Elfving
3,172,269 A 3/1965 Cole
3,175,369 A 3/1965 Murphy et al.
3,192,726 A 7/1965 Newton
3,195,315 A 7/1965 Boehmer et al.
3,200,600 A 8/1965 Elfving
3,205,666 A 9/1965 Gould et al.
3,225,549 A 12/1965 Elfving
3,232,064 A 2/1966 Murphy et al.
3,884,386 A 5/1975 Urcola
4,007,604 A 2/1977 Ballarin
4,055,053 A 10/1977 Elfving et al.
4,242,874 A 1/1981 Simms
4,270,364 A 6/1981 Oonishi et al.
4,487,024 A 12/1984 Fletcher et al.
4,587,810 A 5/1986 Fletcher
4,644,753 A 2/1987 Burke
4,727,720 A 3/1988 Wernicki
4,759,164 A 7/1988 Abendroth et al.
4,759,190 A 7/1988 Trachtenberg et al.
4,823,554 A 4/1989 Trachetenberg et al.
5,226,296 A 7/1993 Kolvites et al.
5,513,495 A 5/1996 West et al.
5,560,211 A 10/1996 Parker
5,653,114 A 8/1997 Newman et al.
5,778,677 A 7/1998 Hung et al.
5,884,487 A 3/1999 Davis et al.
5,931,003 A 8/1999 Newman et al.

(Continued)

*Primary Examiner* — Mohammad M Ali

(57) ABSTRACT

A refrigerator includes a refrigerator cabinet having a fresh food compartment and a freezer compartment. There is a fresh food compartment door for providing access to the fresh food compartment and an ice compartment mounted at the fresh food compartment door. A cold plate is mounted within the fresh food compartment and adapted for cooling the ice compartment when the fresh food compartment door is in a closed position.

21 Claims, 3 Drawing Sheets

(56) References Cited

U.S. PATENT DOCUMENTS

| | | | | |
|---|---|---|---|---|
| 6,125,639 | A | 10/2000 | Newman et al. | |
| 6,286,331 | B1 | 9/2001 | Lee | |
| RE37,696 | E | 5/2002 | Parker | |
| 6,401,461 | B1 | 6/2002 | Harrison et al. | |
| 6,422,031 | B1 | 7/2002 | Mandel et al. | |
| 6,658,879 | B2 | 12/2003 | Park et al. | |
| 6,735,959 | B1 | 5/2004 | Najewicz | |
| 6,820,433 | B2 | 11/2004 | Hwang | |
| 6,951,113 | B1 | 10/2005 | Adamski | |
| 7,210,298 | B2 | 5/2007 | Lin | |
| 7,216,490 | B2 | 5/2007 | Joshi | |
| 7,228,702 | B2 * | 6/2007 | Maglinger et al. | 62/344 |
| 7,614,244 | B2 * | 11/2009 | Venkatakrishnan et al. | 62/187 |
| 2002/0053210 | A1 | 5/2002 | Koster | |
| 2002/0078705 | A1 | 6/2002 | Schlosser et al. | |
| 2002/0121096 | A1 | 9/2002 | Harrison et al. | |
| 2004/0139760 | A1 | 7/2004 | Manole | |
| 2004/0144100 | A1 | 7/2004 | Hwang | |
| 2004/0237565 | A1 * | 12/2004 | Lee et al. | 62/344 |
| 2005/0097909 | A1 | 5/2005 | Cleland | |
| 2005/0126185 | A1 | 6/2005 | Joshi | |
| 2005/0144971 | A1 | 7/2005 | Zabtcioglu | |
| 2005/0229607 | A1 | 10/2005 | Lin | |
| 2006/0086130 | A1 * | 4/2006 | Anselmino et al. | 62/344 |
| 2006/0134296 | A1 | 6/2006 | Lin | |
| 2006/0248918 | A1 | 11/2006 | Robertson | |
| 2006/0260325 | A1 | 11/2006 | Lin | |

* cited by examiner

ICE MAKING IN THE REFRIGERATION COMPARTMENT USING A COLD PLATE

FIELD OF THE INVENTION

The present invention relates to the field of refrigeration. More specifically, the present invention relates to refrigerators where an ice compartment is remote from the freezer compartment.

BACKGROUND OF THE INVENTION

Dispensing ice through the door in a refrigerator may sometimes be desirable to consumers as it enables them to access ice without opening the cabinet door. Currently side-by-side refrigerator-freezers provide this capability by making ice in the freezer compartment, storing it in the freezer compartment or its door and dispensing it through the door. Thus the side-by-side configuration is well-suited for dispensing ice from the door.

Some manufacturers of bottom-mount refrigerator-freezers, a configuration in which the freezer compartment is mounted below the refrigeration or fresh food compartment, have provided an ice-dispenser through the fresh food compartment door. They have accomplished this by bringing cold air to the fresh food compartment from the freezer compartment to make and store ice and dispense the stored ice through the fresh food compartment door. Others have placed a secondary evaporator inside the fresh food compartment to produce and store ice. Such approaches can be problematic in that they use significant space in the fresh food compartment that is highly desired by the customer of bottom-mount refrigerators. Hence, problems exist.

Therefore what is needed is refrigerator with an ice compartment remote from the freezer compartment which requires only limited space in the fresh food compartment.

BRIEF SUMMARY OF THE INVENTION

Therefore, it is a primary object, feature, or advantage of the present invention to improve over the state of the art.

It is a further object, feature, or advantage of the present invention to provide for a refrigerator with an ice compartment remote from the freezer compartment.

It is a still further object, feature, or advantage of the present invention to provide for an ice dispenser in a fresh food door that does not overly limit the useable space in the refrigeration compartment available to consumers.

One or more of these and/or other objects, features, or advantages of the present invention will become apparent from the specification and claims that follow.

According to one aspect of the present invention, a refrigerator includes a refrigerator cabinet having a fresh food compartment and a freezer compartment. There is a fresh food compartment door for providing access to the fresh food compartment and an ice compartment mounted at the fresh food compartment door. The ice compartment houses an ice-maker and includes an ice storage bin. A cold plate is mounted within the fresh food compartment and adapted for cooling the ice compartment when the fresh food compartment door is in a closed position.

According to another aspect of the present invention, a refrigerator includes a refrigerator cabinet having a fresh food compartment and a freezer compartment and a fresh food compartment door for providing access to the fresh food compartment. There is an ice compartment mounted at the fresh food compartment door and an ice maker within the ice compartment. A cold plate is mounted within the fresh food compartment and adapted for cooling the ice compartment sufficiently to produce ice with the ice maker when the fresh food compartment door is in a closed position. The cold plate also provides cooling for ice in the storage bin of the ice compartment. There is an opening in the ice compartment corresponding with the cold plate when the fresh food compartment door is in the closed position. Another opening in the ice compartment enables the customer to access bulk ice.

According to yet another aspect of the present invention, a refrigerator includes a refrigerator cabinet having a fresh food compartment and a freezer compartment, the freezer compartment mounted below the fresh food compartment. There is a fresh food compartment door for providing access to the fresh food compartment. There is also an ice and water dispenser mounted on the fresh food compartment door. An ice compartment is mounted at the fresh food compartment door and there is an ice maker within the ice compartment. A cold plate is mounted within the fresh food compartment and adapted for cooling the ice compartment sufficiently to produce and store ice when the fresh food compartment door is in a closed position. There is an opening in the ice compartment corresponding with the cold plate when the fresh food compartment door is in the closed position. There is also an annular gasket mounted at the opening to assist in sealing the cold plate to the ice compartment when the fresh food compartment door is in the closed position.

According to another aspect of the present invention, a method is provided for making ice in a bottom mount refrigerator having a refrigerator cabinet and a fresh food compartment and a freezer compartment within the fresh food compartment, the freezer compartment below the fresh food compartment, and a fresh food compartment door providing access to the fresh food compartment. The method includes cooling an ice compartment mounted at the fresh food compartment door with a cold plate mounted within the fresh food compartment while the fresh food compartment door is in a closed position and making and storing ice within the ice compartment.

The cooling plate can be cooled by various means, including the use of a refrigerant, a secondary refrigerant (such as glycol and other secondary coolants), air from the freezer compartment, or a thermoelectric device.

Although the cold plate and other aspects of the invention disclosed herein are intended primarily for use with bottom mount refrigerators, the invention is also suitable for use with other configurations, such as conventional side-by-side and top mount refrigerator platforms.

DETAILED DESCRIPTION OF THE PREFERRED EMBODIMENT

The present invention relates to the use of an ice maker and ice storage bin remote from the freezer compartment. Such a need exists in a bottom mount refrigerator where the ice maker and ice storage bin are located at the fresh food compartment door. The following exemplary embodiment is shown and described in the context of a bottom mount refrigerator. However, this disclosure is not meant to be limiting, as the invention can also be applied to other configurations, such as conventional side-by-side and top mount refrigerators.

Figure 1:
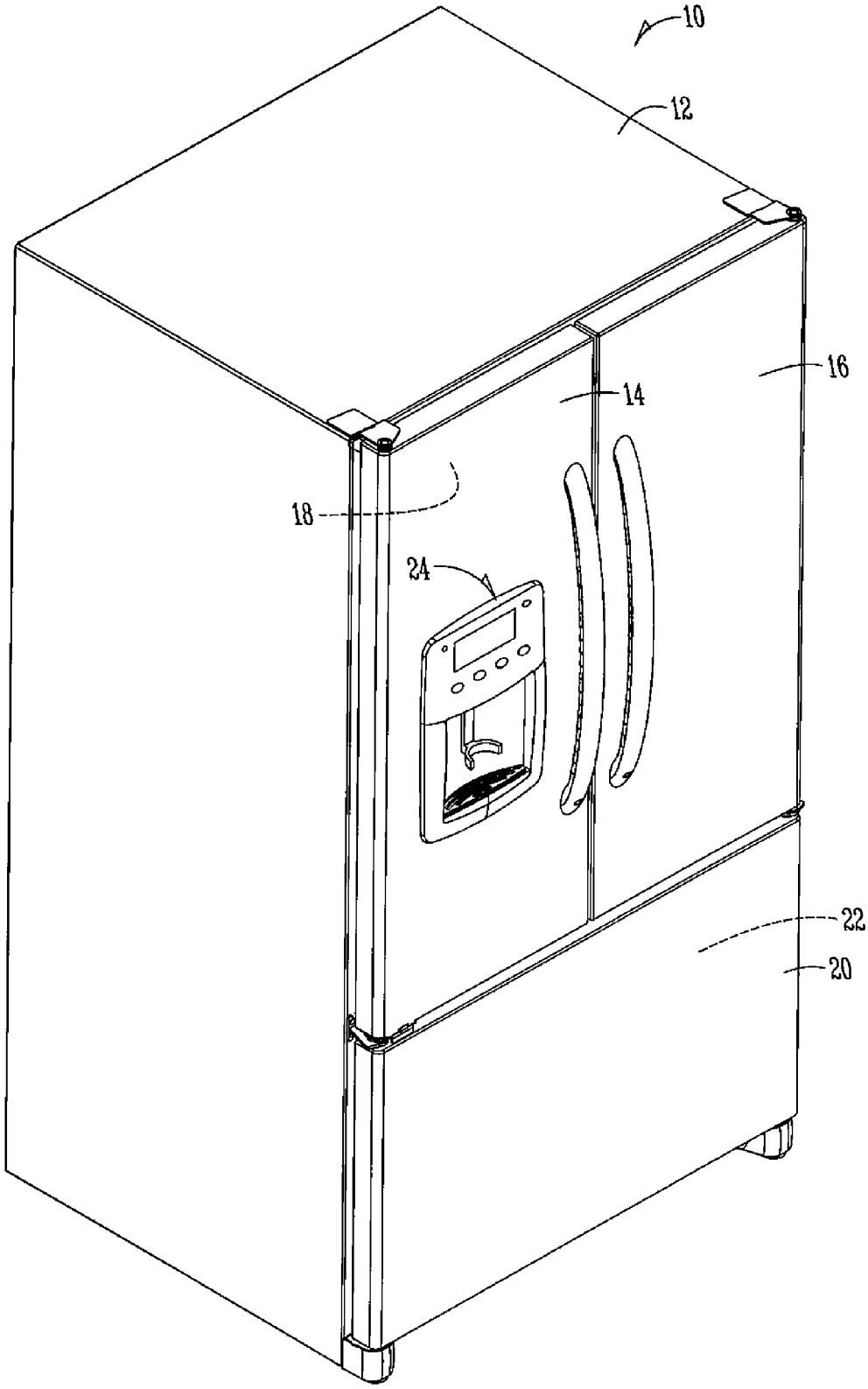
FIG. 1 is a perspective view of one embodiment of a bottom mount refrigerator.

FIG. 1 illustrates one embodiment of a refrigerator 10. The refrigerator 10 includes a refrigerator housing or cabinet 12. A first fresh food compartment door 14 and a second fresh food compartment door 16 provide access to a fresh food compartment 18. A freezer door 20 provides access to the freezer compartment 22. The refrigerator 10 is shown in a bottom mount configuration in that the freezer compartment 22 is positioned below the refrigeration or fresh food compartment 18. An ice and water dispenser 24 is positioned on the first fresh food compartment door 14. Note that the ice and water dispenser 24 is positioned remotely from the freezer compartment 22.

Figure 2:
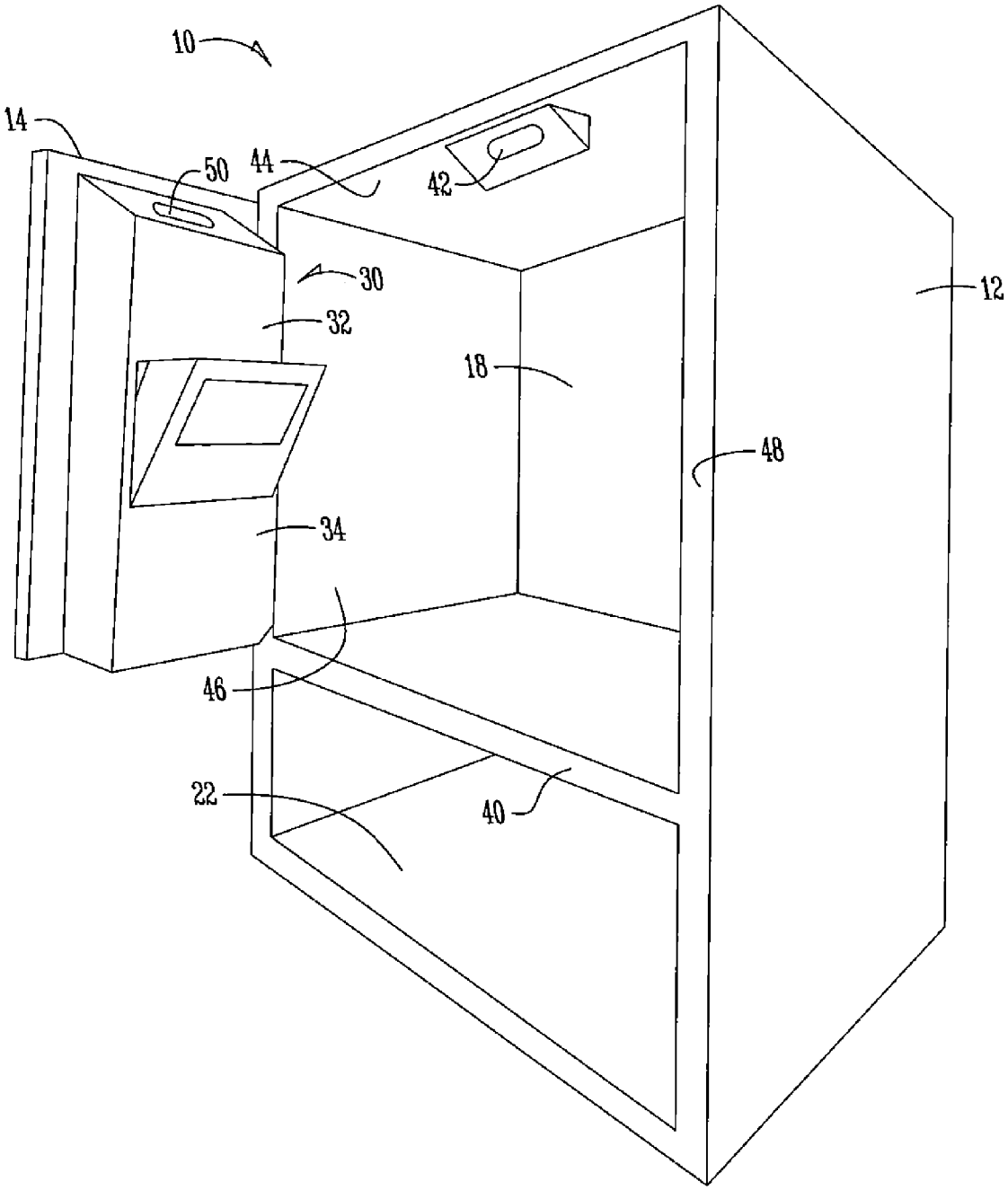
FIG. 2 is a perspective view of the refrigerator of FIG. 1 with a cold plate mounted in a top wall of the refrigerator cabinet.

FIG. 2 illustrates the refrigerator 10 of FIG. 1 with the first fresh food compartment door 14 in an open position. For purposes of illustration, the freezer compartment door is not shown and the second fresh food compartment door is also not shown. A mullion 40 is shown which separates the fresh food compartment 18 and the freezer compartment 22. The mullion 40 is an insulated wall to assist in maintaining separate temperatures in the different compartments 18, 22. An ice compartment 30 is shown which is positioned at the inside of the first refrigeration compartment door 14. The ice compartment 30 includes a direct contact ice maker 32 and an ice storage area or ice bin 34. The ice compartment 30 also permits access to bulk ice, as a tilting bucket portion is movable between a closed position and an open position. This tilt out bucket feature is disclosed in more detail in pending application "Tilt-Out Ice Bin For Refrigerator", application Ser. No. 11/283,970 filed on Nov. 21, 2005.

The ice maker 32 is cooled conductively through use of a cold plate 42 when the first fresh food compartment door 14 is closed. The cold plate 42 may be placed in the top wall 44 of the cabinet 12. Alternatively, the cold plate 42 may be placed in the sidewall 46 of the cabinet 12. The contact between the ice mold and the cold plate 42 may be augmented in various ways such as through use of magnetic attraction or use of a thermally conductive flexible pad or a Hg or glycol filled boot. The cold plate 42 is preferably cooled by means of a primary or secondary refrigerant. It is also possible to cool the cold plate 42 with cold air from the freezer compartment 22 or a thermoelectric device.

The ice compartment 30 is an insulated compartment at the door 14. As shown in FIG. 2, the ice compartment 30 has an opening 50 to communicate with the cold plate 42. When the fresh food compartment door 14 is closed, the ice compartment 30 closes with the top wall 44 of the cabinet 12 thereby forming an insulated and sealed compartment to make and store ice. To further enhance heat transfer from the ice maker and storage bin of the ice compartment 30 to the cold plate, the opening 50 may have an annular gasket 52 extending along the periphery to assist in sealing and preventing air leaks. The present invention also contemplates that numerous other methods may be used to enhance heat transfer from the ice maker and storage bin within the ice compartment to the cold plate. For example, a fan may be used to circulate air.

It is expected that the cold plate 42 may become frosted up, such as from ambient air that enters while the door 14 is open, from sublimation of ice, or from evaporation of water in the ice mold. The present invention also contemplates that the frost may be removed from the cold plate. One way to do so is to periodically heat the cold plate using either an electric heater or hot gas from the condenser of the refrigerator. The heating removes frost buildup on the surface of the hot plate. An alternative way to reduce frost build up on the cold plate is maintain a portion of the cold plate at a temperature colder than the entire plate. This coldest portion would service to collect the frost. This portion of the cold plate may be defrosted periodically by heating it and the defrost water could be collected in the drain-pan of the refrigerator or in a tray about the water dispenser 24.

Figure 3:
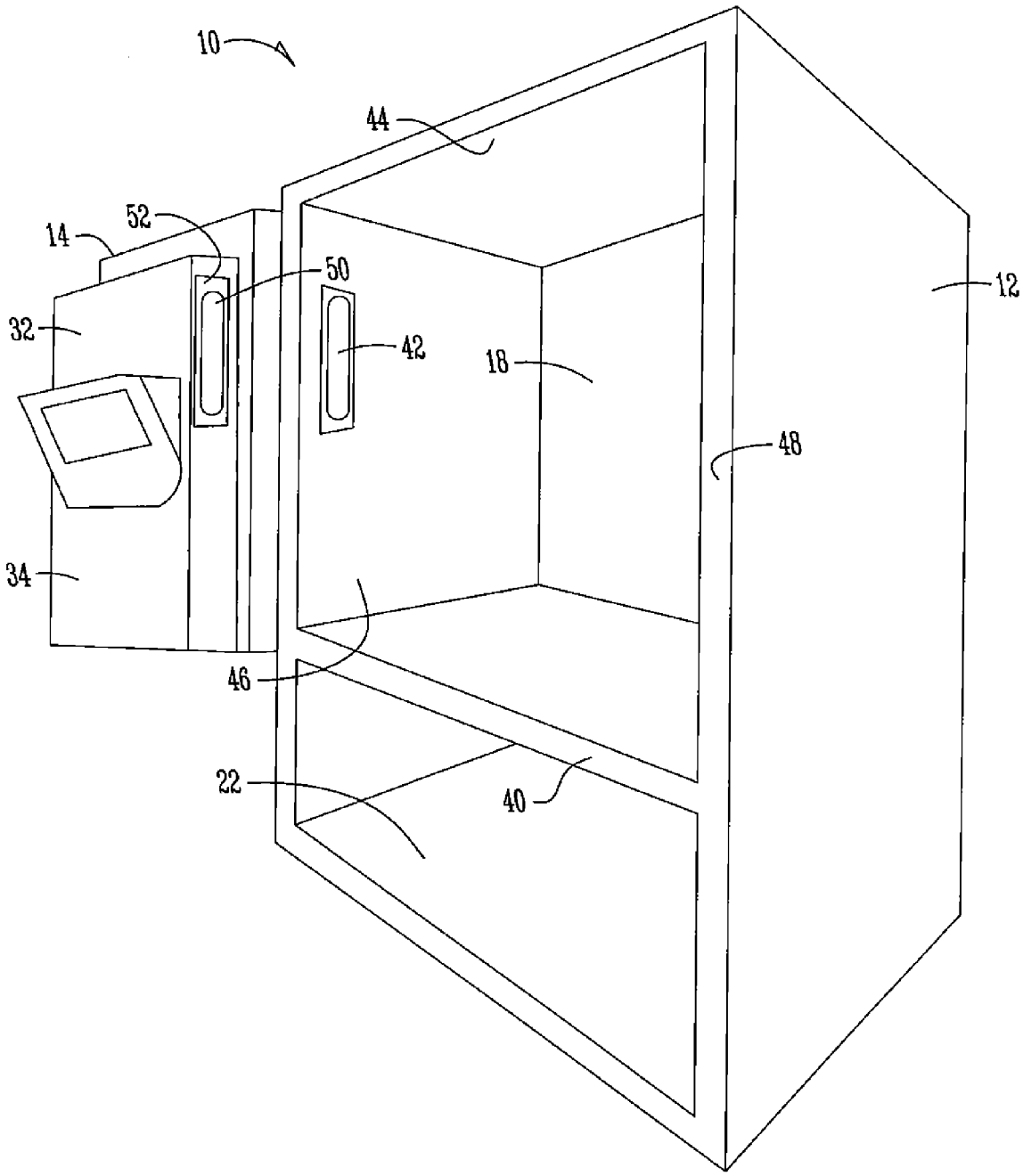
FIG. 3 is a perspective view of the refrigerator of FIG. 1 with a cold plate mounted in a side wall of the cabinet.

FIG. 3 illustrates the refrigerator 10 of FIG. 1 with the first fresh food compartment door 14 in an open position and with a different placement of the cold plate 42 than shown in FIG. 2. In FIG. 3, the cold plate 42 is positioned along a sidewall 46 of the cabinet 12. The contact between the ice maker 32 within the ice compartment 30 and the cold plate 42 provides for conductive cooling when the first fresh food compartment door 14 is closed.

The description provided herein is merely exemplary in nature and, thus, contemplates numerous variations, options, and alternatives. For example, variations in the configuration of the refrigerator, variations in the placement of the cold plate, variations in the manner in which frost buildup is avoided or reduced, and other variations, options and alternatives are within the spirit and scope of the invention.

What is claimed is:

1. A refrigerator comprising:

a refrigerator cabinet having a fresh food compartment and a freezer compartment;

a fresh food compartment door having an open position for providing access to the fresh food compartment and a closed position for restricting access to the fresh food compartment;

an ice compartment mounted at the fresh food compartment door and comprising an ice maker and an ice storage area wherein the ice storage area is separate from the ice maker and receives dispensed ice from the ice maker; and a cold plate mounted at the fresh food compartment external of the both ice maker and ice storage area of the ice compartment, the cold plate being separated from the ice maker when the fresh food compartment door is in the open position and being adjacent to and in thermally conductive contact with the ice maker when the fresh food compartment door is in a closed position.

2. The refrigerator of claim 1 wherein the cold plate is mounted on a sidewall of the fresh food compartment and wherein an opening in the ice compartment is positioned proximate the cold plate when the fresh food compartment door is in the closed position.

3. The refrigerator of claim 2 further comprising an annular gasket mounted at the opening to assist in sealing the cold plate to the ice compartment when the fresh food compartment door is in the closed position.

4. The refrigerator of claim 1. wherein the cold plate is mounted on a top wall of the fresh food compartment and wherein an opening in the ice compartment is positioned proximate the cold plate when the fresh food compartment door is in the closed position.

5. The refrigerator of claim 1 wherein the cold plate is configured for removal of frost buildup.

6. The refrigerator of claim 1 wherein the freezer compartment is mounted below the fresh food compartment.

7. The refrigerator of claim 1 further comprising an ice and water dispenser mounted on the fresh food compartment door.

8. The refrigerator of claim 1 wherein the cold plate is in direct contact with at least a portion of the ice compartment when the fresh food door is in the closed position.

9. A refrigerator comprising:

a refrigerator cabinet having a fresh food compartment and a freezer compartment;

a fresh food compartment door for providing access to the fresh food compartment;

an ice compartment mounted on the fresh food compartment door;

an ice maker within the ice compartment;

an ice storage area within the ice compartment, wherein ice dispensed from the ice maker is stored in the ice storage area;

a cold plate mounted on a wall of the fresh food compartment and adapted for conductively cooling the ice maker sufficiently to produce ice with the ice maker when the fresh food compartment door is in a closed position;

an opening in the ice compartment corresponding with the cold plate such that the cold plate is adjacent to and in thermally conductive contact with the ice maker when the fresh food compartment door is in the closed position and is separated from the ice maker when the fresh food compartment door is in an open position;

wherein the cold plate is in direct contact with at least a portion of the ice maker when the fresh food compartment door is in the closed position;

wherein the cold plate is external of both the ice maker and ice storage area of the ice compartment.

10. The refrigerator of claim 9 further comprising an annular gasket mounted at the opening to assist in sealing the cold plate to the ice compartment when the fresh food compartment door is in the closed position.

11. The refrigerator of claim 10 wherein the cold plate is mounted on a sidewall of the fresh food compartment.

12. The refrigerator of claim 10 wherein the cold plate is mounted on a top wall of the fresh food compartment.

13. The refrigerator of claim 10 wherein the freezer compartment is mounted below the fresh food compartment.

14. The refrigerator of claim 10 further comprising an ice and water dispenser mounted on the fresh food compartment door.

15. A refrigerator comprising:

a refrigerator cabinet having a fresh food compartment and a freezer compartment, the freezer compartment mounted below the fresh food compartment;

a fresh food compartment door for providing access to the fresh food compartment when the door is in an open position;

an ice and water dispenser mounted on the fresh food compartment door;

an ice compartment mounted on the fresh food compartment door;

an ice maker and an ice storage area separate from the ice maker within the ice compartment;

a cold plate mounted on a wall of the fresh food compartment and adapted for conductively cooling the ice maker sufficiently to produce ice with the ice maker by being brought into thermally conductive contact with the ice maker when the fresh food compartment door is in a closed position, the cold plate being separated from the ice maker When the fresh food compartment door is in the open position;

an opening in the ice compartment corresponding with the cold plate when the fresh food compartment door is in the closed position; and an annular gasket mounted at the opening to assist in sealing the cold plate to the ice compartment when the fresh food compartment door is in the closed position;

wherein the cold plate is in direct contact with at least a portion of the ice maker when the fresh food compartment door is in the closed position;

wherein the cold plate is external of both the ice maker and the ice storage area of the ice compartment.

16. A method of making ice in a bottom mount refrigerator having a refrigerator cabinet and a fresh food compartment and a freezer compartment within the fresh food compartment, the freezer compartment below the fresh food compartment, a fresh food compartment door providing access to the fresh food compartment, an ice maker mounted at an ice compartment on the fresh food compartment door, and a cold plate mounted at the fresh food compartment external of both the ice maker and an ice storage compartment of the ice compartment, the method comprising:

bringing the cold plate adjacent to and into thermally conductive contact with the ice maker by adjusting the fresh food compartment door into a closed position;

conductively cooling the ice maker with the cold plate; and dispensing ice from the ice maker into the ice storage compartment.

17. The method of claim 16 wherein the ice compartment includes a portion movable between a closed position and an open position providing an opening for bulk ice access.

18. The method of claim 16 further comprising removing frost buildup from the cold plate.

19. The method of claim 18 wherein the removing frost buildup from the cold plate being performed by heating the cold plate.

20. The method of claim 16 wherein the cold plate is mounted on a side wall of the fresh food compartment.

21. The method of claim 16 wherein the cold plate is mounted on a top wall of the fresh food compartment.

* * * * *